US006332424B1

(12) United States Patent
Frink

(10) Patent No.: US 6,332,424 B1
(45) Date of Patent: Dec. 25, 2001

(54) HANDS FREE SIGNAL DEVICE

(76) Inventor: Stephen B. Frink, 491 Barracuda Blvd., Key Largo, FL (US) 33037

( * ) Notice: Subject to any disclaimer, the term of this patent is extended or adjusted under 35 U.S.C. 154(b) by 0 days.

(21) Appl. No.: 09/324,609

(22) Filed: Jun. 2, 1999

(51) Int. Cl.[7] ..... B64B 1/40
(52) U.S. Cl. ..... 116/210; 441/90
(58) Field of Search ..... 116/210, DIG. 7, 116/DIG. 8, DIG. 9; 441/90, 92, 93, 94, 96, 106, 114, 117, 119, 121

(56) References Cited

U.S. PATENT DOCUMENTS

| | | | | |
|---|---|---|---|---|
| D. 342,666 | | 12/1993 | DePack | D8/373 |
| D. 347,873 | | 6/1994 | Lohn | D21/237 |
| D. 377,382 | | 1/1997 | Saunders et al. | D21/236 |
| 3,877,096 | * | 4/1975 | Scesney | 116/210 |
| 3,964,266 | | 6/1976 | Bartlett | 61/70 |
| 3,975,785 | * | 8/1976 | Stadeker | 441/93 |
| 4,094,267 | * | 6/1978 | Davis, Jr. | 116/210 |
| 4,095,667 | | 6/1978 | Mahig et al. | 181/120 |
| 4,114,561 | * | 9/1978 | Asaro | 116/210 |
| 4,240,371 | * | 12/1980 | Perry | 116/210 |
| 4,295,438 | | 10/1981 | Porter | 116/210 |
| 4,324,507 | | 4/1982 | Harrah | 405/186 |
| 4,433,638 | * | 2/1984 | Ashline | 116/210 |
| 4,586,456 | * | 5/1986 | Forward | 116/210 |
| 4,635,754 | * | 1/1987 | Aschauer et al. | 441/93 |
| 4,681,552 | | 7/1987 | Courtney | 441/92 |
| 4,697,706 | * | 10/1987 | Schaller | 116/210 |
| 4,752,263 | | 6/1988 | Pritchard et al. | 441/88 |
| 4,852,510 | | 8/1989 | Joseph, Jr. et al. | 116/140 |
| 4,858,204 | | 8/1989 | Holston et al. | 367/141 |
| 4,893,580 | | 1/1990 | Joseph, Jr. et al. | 116/137 |
| 4,912,777 | | 4/1990 | Gasbarro | 2/2.1 R |
| 4,998,499 | | 3/1991 | Nordbeck | 116/142 FP |
| 5,020,941 | | 6/1991 | Bulin et al. | 405/186 |
| 5,067,855 | | 11/1991 | Kamitani | 405/186 |
| 5,079,753 | | 1/1992 | Suggs | 367/107 |
| 5,129,351 | | 7/1992 | Feder | 116/307 |
| 5,183,003 | | 2/1993 | Powell et al. | 116/26 |
| 5,213,095 | | 5/1993 | Dague | 128/204.18 |
| 5,256,094 | | 10/1993 | Canna | 441/96 |
| 5,271,387 | | 12/1993 | Murray | 128/200.24 |
| 5,301,631 | * | 4/1994 | Vining | 116/210 |
| 5,302,055 | | 4/1994 | Johnston | 405/186 |
| 5,378,084 | | 1/1995 | Walters et al. | 405/186 |
| 5,474,481 | | 12/1995 | Ramsey | 441/131 |
| 5,516,233 | | 5/1996 | Courtney | 405/186 |
| 5,516,234 | | 5/1996 | Duchesne | 405/186 |
| 5,516,316 | | 5/1996 | Rumminger | 441/1 |
| 5,551,800 | | 9/1996 | Hobelsberger | 405/186 |
| 5,555,839 | * | 9/1996 | Staten et al. | 116/210 |
| 5,570,323 | | 10/1996 | Prichard et al. | 367/118 |
| 5,584,287 | | 12/1996 | Smith et al. | 128/202.22 |
| 5,603,065 | | 2/1997 | Baneth | 395/893 |
| 5,622,422 | | 4/1997 | Rodgers | 362/158 |
| 5,640,922 | | 6/1997 | Feldkamp et al. | 114/315 |
| 5,660,503 | | 8/1997 | Lewis | 405/186 |
| 5,666,326 | | 9/1997 | Holzschuh | 367/120 |
| 5,697,572 | | 12/1997 | Salentine et al. | 242/379 |
| 5,735,719 | * | 4/1998 | Berg | 441/11 |
| 5,788,475 | | 8/1998 | Henderson | 405/186 |
| 6,158,380 | * | 12/2000 | Aschauer et al. | 116/210 |

* cited by examiner

*Primary Examiner*—Andrew H. Hirshfeld
(74) *Attorney, Agent, or Firm*—Lyon & Lyon LLP

(57) ABSTRACT

A hands free signal device for use in conjunction with a scuba system. The hands free signal device includes an inflatable member engaged with an inflation source. The inflation source, for example, can be a tank of compressed air commonly used in scuba diving or can be a smaller, self-contained cylinder of carbon dioxide. The signaling device is adapted for use in conjunction with a scuba diving buoyancy compensation jacket and is activated by pulling on a cord within easy reach of the scuba diver.

15 Claims, 6 Drawing Sheets

FIG. 1
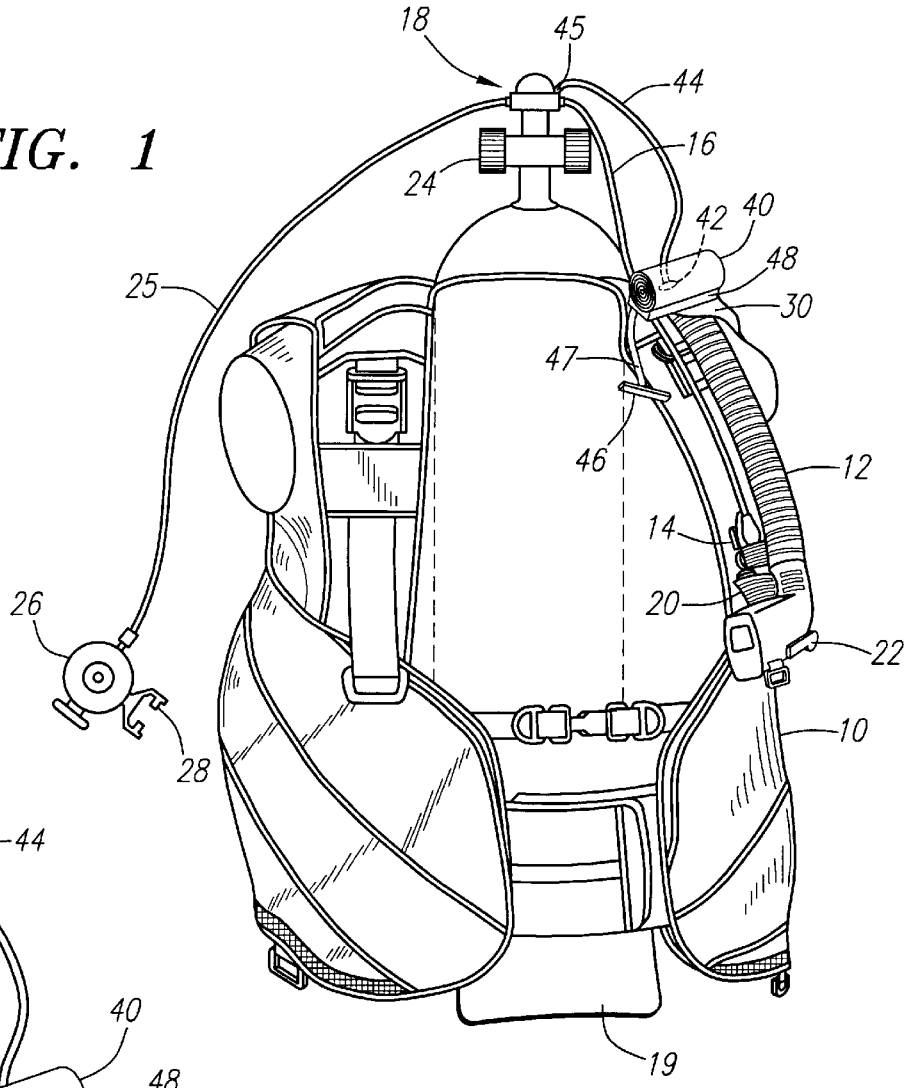
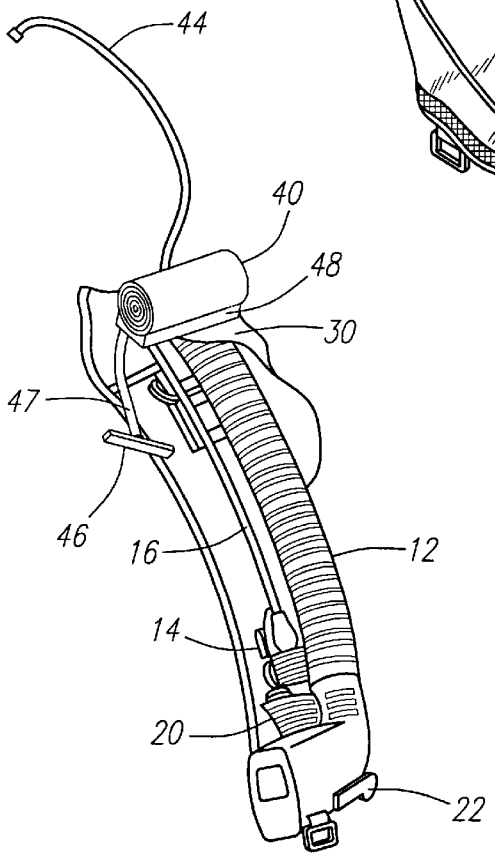
FIG. 2

HANDS FREE SIGNAL DEVICE

FIELD OF THE INVENTION

The present invention relates to a signaling device, and more particularly, to a hands free signaling device for scuba divers.

BACKGROUND OF THE INVENTION

Scuba (Self Contained Underwater Breathing Apparatus) diving has continued to grow in popularity over the last decade and has rapidly progressed from a sport enjoyed only by a select group of people to an activity in which the entire family can participate. The predominance of privately run scuba certification classes around the country and abroad has tremendously increased the diving population over the recent years. In addition to the recreational aspects of the sport, scuba diving continues to be practiced for many commercial, technical, scientific and military purposes.

Coastal vacation resorts often offer a range of available courses for those who wish to experience scuba diving. These courses range from an introductory resort course, where a new diver can take a quick orientation lesson and then be accompanied by an experienced guide into an open water environment, to a week long scuba certification program, where the diver receives a certification card and is then capable of unsupervised diving. These certification courses are often endorsed by one of several national scuba organizations. As a result, private dive companies typically have a large percentage of beginner or first time scuba divers under their supervision.

When properly trained, scuba diving is a safe and enjoyable sport. However, there are certain inherent risks associated with scuba diving that will always need to be addressed. These risks must be addressed by both the individual scuba divers and the dive operators who are supervising the trip. Even on a short dive, a scuba diver can cover a large area and lose his sense of direction very easily. Furthermore, underwater navigation can be confusing, particularly for a beginning scuba diver. Poor visibility, bad weather, strong water currents and various other factors can result in a diver becoming separated from the dive leader. It is not uncommon for a scuba diver to surface several hundred yards away from the rest of the dive group or the dive boat. In these cases it becomes essential to quickly locate the missing diver so that he can be retrieved or otherwise rescued.

Various signaling devices have been developed for such situations. However, many of these devices have relied upon audible signals, such as whistles or horns. These audible signaling devices require some level of manual dexterity to activate and may not successfully attract the attention of a boat which has twenty to thirty other noisy divers on board. This, in combination with the boat noise and normal environmental noise, renders most of these devices ineffective. A novice diver may not feel comfortable removing his air source (regulator) from his mouth in order to blow a whistle or may not have the strength to activate another audible device. Muscle cramps, fatigue or other injuries may further prevent a diver from activating such a device. Even audible devices which operate on the remaining air pressure in a scuba tank may be ineffective. If the air pressure in the tank is running low, which is typically the case at the end of a dive, there may not be enough pressure to sustain an audible sound for a long enough period of time. The low air pressure may not even activate such a device at all.

Other inflatable signaling devices require the diver to remove the inflatable device from a pocket in the buoyancy control device (BCD) or unclip it from a BCD. After removing the inflatable device from its storage location, the diver must locate the inflation opening and manually connect the inflatable devices to some air source, either an alternative air source (e.g., a SPAREAIR™ bottle or the octopus). When the diver is exhausted and panicky, this is not the optimal procedure.

It is not only the novice diver who must be conscious of these problems. Experienced divers, even those with substantial specialized training, must frequently signal a boat or a rescue team which may be far away from their surfacing location. In particular, an underwater photographer, rescue diver, commercial maintenance diver, or other diver who carries various pieces of extra equipment, may not have a free hand to easily allow him to activate an audible signaling device or inflate other devices. While experienced, typically, these types of divers will also have expended significant energy during the dive and are also susceptible to incidences of fatigue or injury. Furthermore, if an experienced diver is in trouble or surfaces far from the boat, it is more likely that there will be rough water at the surface. Particularly in these circumstances it will be difficult to activate an audible signaling device or inflate other devices that require user interaction.

The need exists for a signaling device which requires minimal user intervention to activate, will maintain a signal for a prolonged period of time and can be noticed at a distance with large swells.

SUMMARY OF THE INVENTION

The present invention comprises a hands free signaling device and method for signaling with minimal manual intervention. A preferred embodiment of one aspect of the invention comprises an inflatable member and an inflation fitting adapted to provide communication between the internal volume of the inflatable member and integrate the device with the inflation source.

In another aspect of the invention, the hands free signaling device is removably integral with a buoyancy compensation and can be activated automatically or manually.

BRIEF DESCRIPTION OF THE DRAWINGS

FIG. 1 is a perspective view of a buoyancy compensating device attached to a tank of compressed air and including a hands free signaling device in accordance with the present invention;

FIG. 2 is a close up perspective view of a portion of the buoyancy compensation device of FIG. 1;

DETAILED DESCRIPTION OF THE PREFERRED EMBODIMENTS

Figure 3:
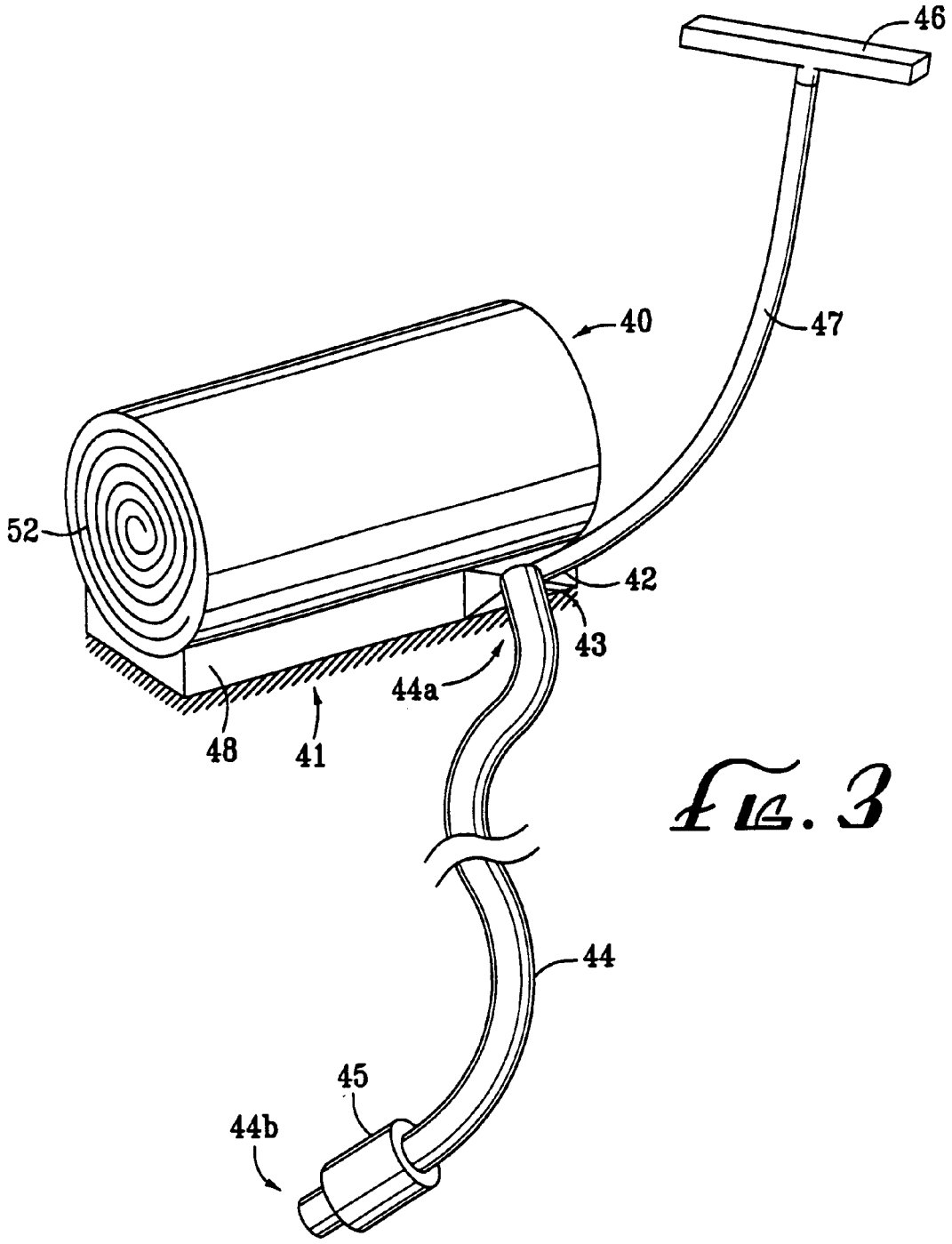
FIG. 3 is a rear perspective view of a hands free signaling device in accordance with the present invention.
Figure 3A:
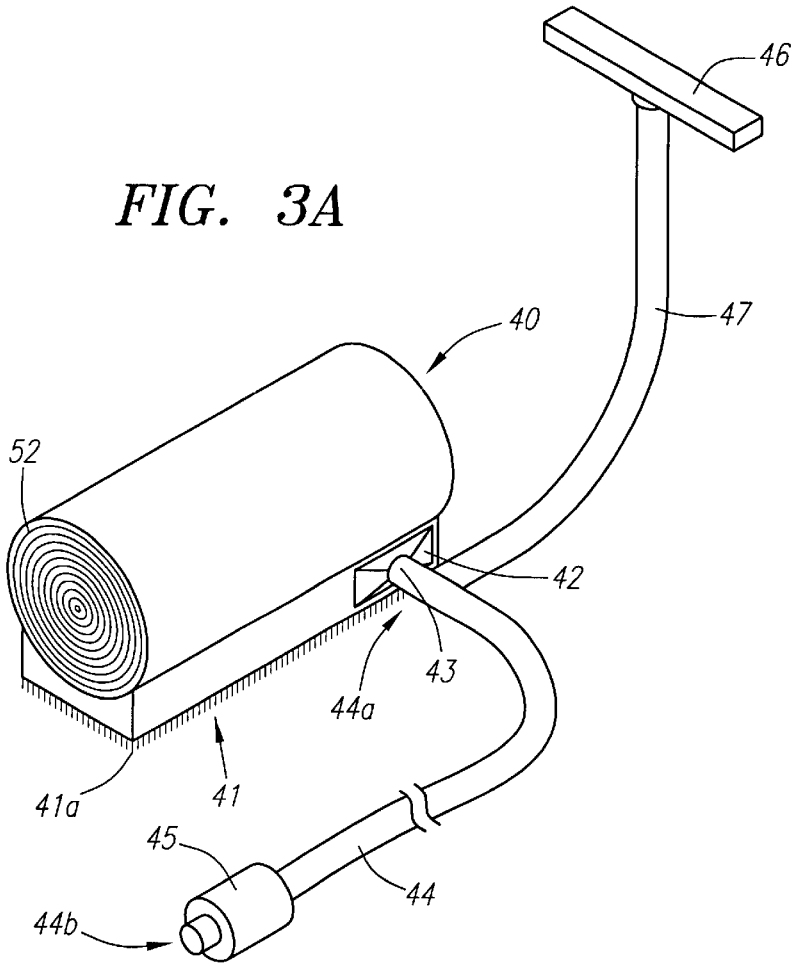
Figure 3B:
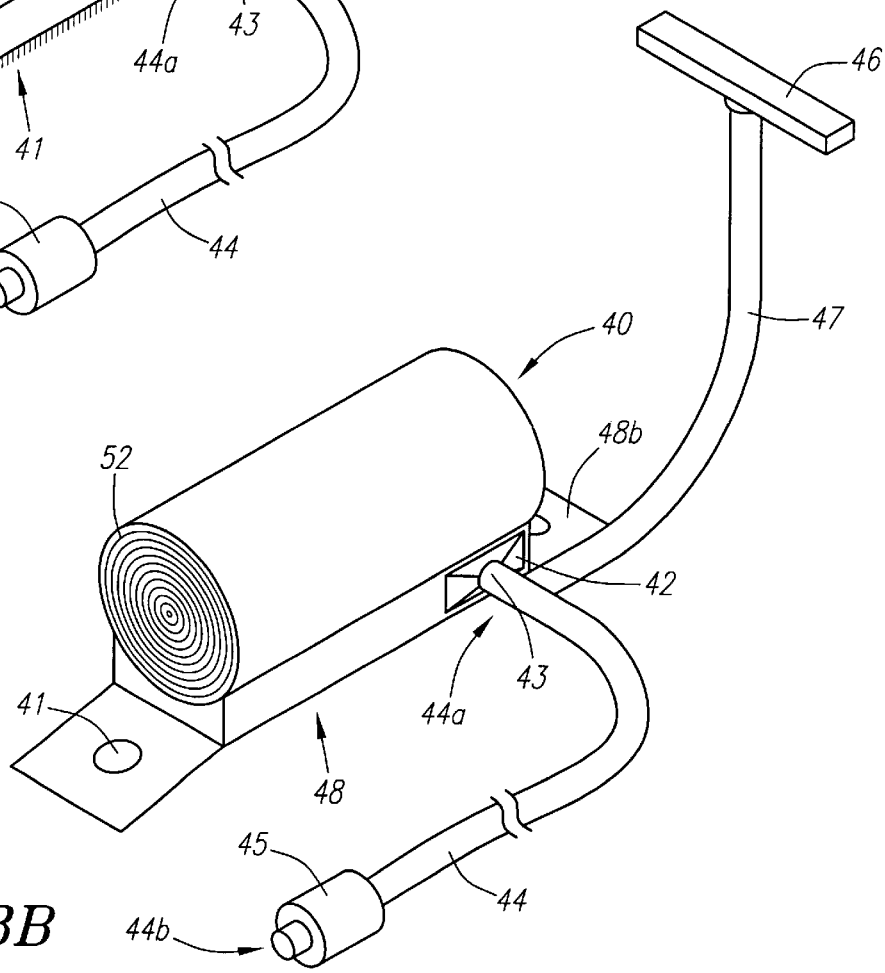
Figure 3C:
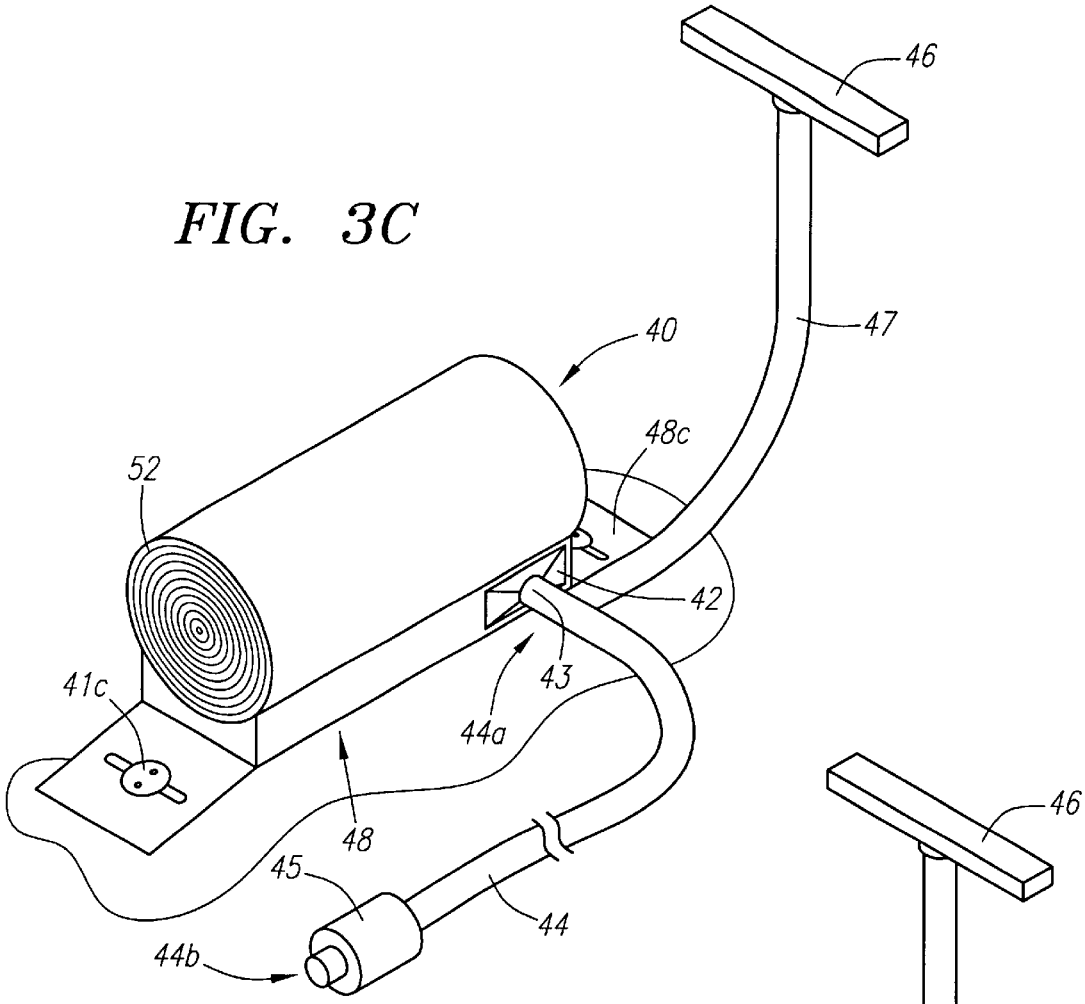
Figure 3D:
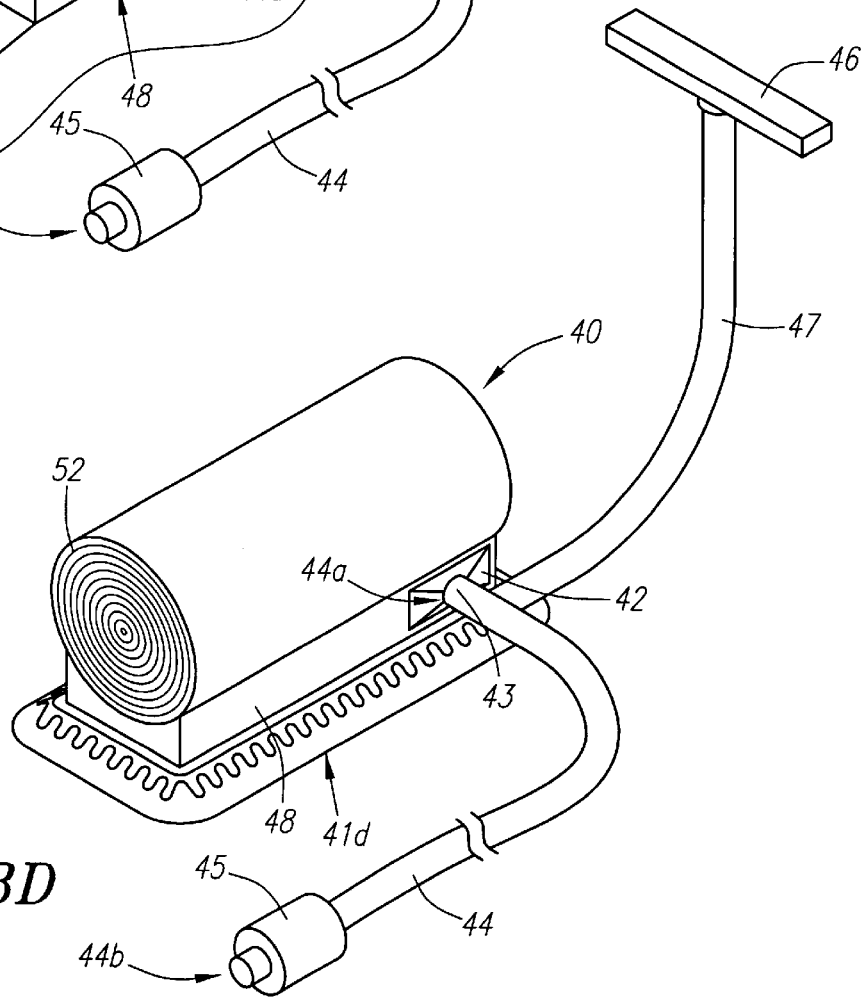

Referring to FIGS. 1–3, a BCD 10 includes a control tube 12 which has a fitting 14 connected to an inflation tube 16. BCD 10 is an inflatable vest or jacket worn by a scuba diver to allow him to accurately control his buoyancy while under water. Inflation tube 16 forms part of a regulator assembly 18 and supplies compressed air from a tank 19 to the BCD 10. Fitting 14 includes an inflation control button 20 and a deflation control button 22 which together allow a diver to adjust the volume of air within the BCD 10. By depressing button 20, air is allowed to flow from tank 19, through the tube 16 and into the BCD 10. By depressing button 22, air is expelled from the BCD 10. BCD devices such as the one shown in FIG. 1 are well known in the scuba diving industry and are manufactured by several companies including U.S. Divers™, Dacor™ and Sherwood™. A first stage 24 of the regulator 18 reduces air pressure from approximately 2250–3000 psi to a constant intermediate air pressure of approximately 105–145 psi. A flexible rubber hose 25 distributes this air to a second stage 26 of the regulator 18. The second stage 26 further reduces the air pressure to an ambient pressure, which can be comfortably breathed by a diver through a mouthpiece 28. The inflation tube 16 also delivers air at an intermediate pressure of approximately 105–145 psi to the BCD 10.

Shown attached to a shoulder strap 30 of the BCD 10 is a hands free signal device 40. The hands free signal device 40 includes an inflatable balloon 52 (shown best in FIG. 3 in a collapsed position) and includes an inflation fitting 42 connected to a device end 44*a* of a flexible tube 44. A source end 44*b* of the flexible tube 44 is connected to the compressed air tank 19 through a fitting 45. Fitting 45 is configured to only allow connection to the low pressure ports of the first stage of the regulator 18. A handle 46 is attached to a cord 47 which in turn is connected to the fitting 42. The handle 46 is preferably clasped to the front of the BCD 10 by a reversible fastening device such as a velcro strip, snap, clip, clamp, or zipper. When the handle 46 is pulled, a one way valve 43 incorporated in fitting 42 is opened, and air is released from the tank 19 through the tube 44 and inflates the balloon 52 on the hands free signal device 40. In FIGS. 1–3, the balloon 52 is shown in its uninflated state. In its uninflated state, the balloon 52 is preferably tightly rolled into a compact unit. When inflated, the balloon unfurls and extends to its full length, assuming preferably an elongate shape (See FIGS. 4A–4C). If a dangling cord for opening the one way valve is undesirable, the valve may be opened by depressing a button in a similar fashion as the one-way valves used for inflating BCD's.

An base 48 of the hands free signal device 40 is preferably attached to the shoulder strap 30 by a reversible fastening device 41. The fastening device 48 is preferably a velcro strip 41*a* which will keep the hands free signal device 40 securely attached to the BCD 10 when it gets wet during the normal wear and tear of diving, or if unintentionally disturbed during a dive. Other reversible fastening devices may be used such as a snap, 41*b* clip, 41*c* clamp, or zipper 41*d*.

When uninflated, the balloon 52 of the hands free signal device 40 is rolled up or otherwise retracted into a compact unit (FIGS. 1–3) and attached to the left side of the BCD. In this uninflated state and position, the hands free signal device 40 causes minimal interference with the movements of the scuba diver and the normal operation of the BCD 10, regulator 18 or any of the associated hoses and fittings. The functioning of the BCD is such that a scuba diver does not normally need to access the shoulder area where the hands free signal device 40 is attached. The hands free signal device 40 is therefore out of the way during a dive but within easy reach of the diver. The preferred reduced profile of the hands free signal device 40 also helps minimize interference with the operation of other scuba equipment.

By pulling on the cord 47 via handle 46, the hands free signal device 40 is activated and air is injected into the inflatable balloon 52, thereby unfurling or otherwise deploying the inflatable balloon 52 so that when filled, it maintains a elongate and erect profile. Sufficient pressure is maintained in the inflatable balloon 52 so that it will remain upright and erect when subject to wind, waves or other movements of the diver. One way valve 43 ensures that air does not escape from the balloon 52 once it is inflated. Preferably a minimum volume of air is required to completely inflate the balloon 52. The inflatable balloon 52 has a small internal volume so that a scuba tank or other air source with little air left will still completely inflate the balloon 52. The inflatable balloon 52 is preferably 4–6 feet in length when deployed so that it can be seen over a large distance even with large swells. Signal devices constructed in accordance with the present invention can utilize balloons of varying length. For instance, in fresh water diving situations, where the chance of large waves or swells is reduced, a shorter balloon may be used. However, in ocean conditions, a longer balloon may be needed to overcome the effect of tall waves which may block the line of sight between the diver and a rescue boat.

Figure 4A:
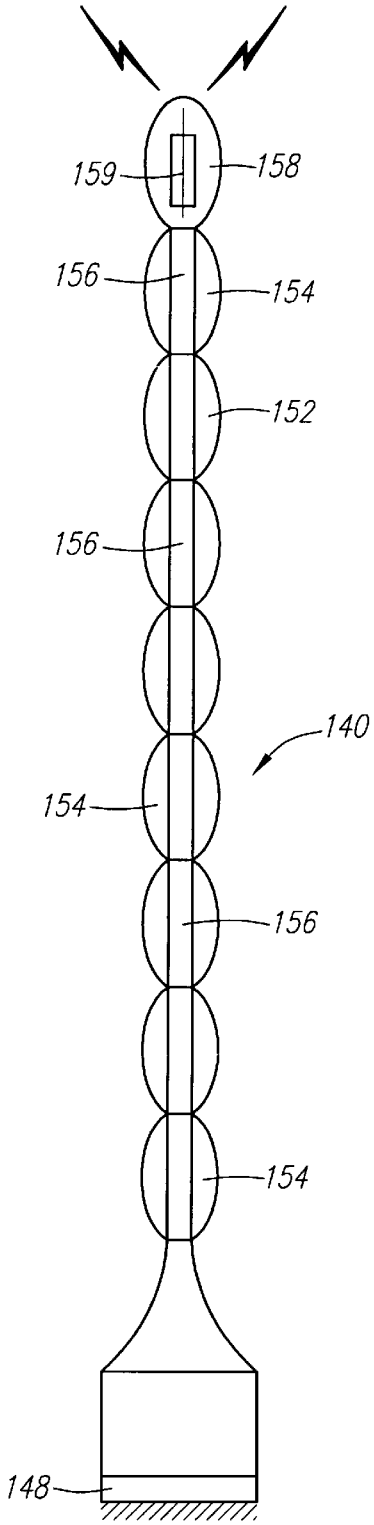
FIGS. 4A–4C are various embodiments of a hands free signaling device in accordance with the present invention.
Figure 4B:
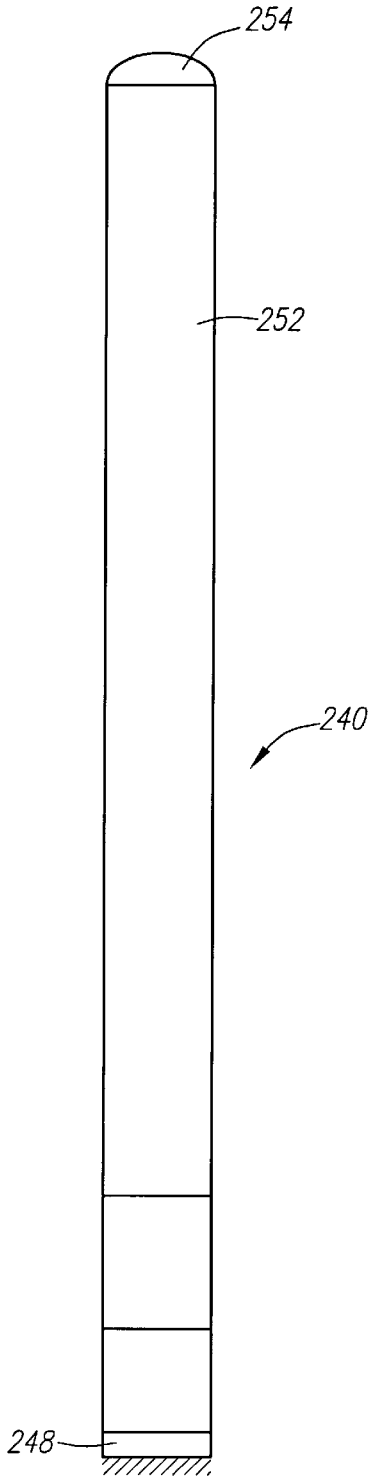
Figure 4C:
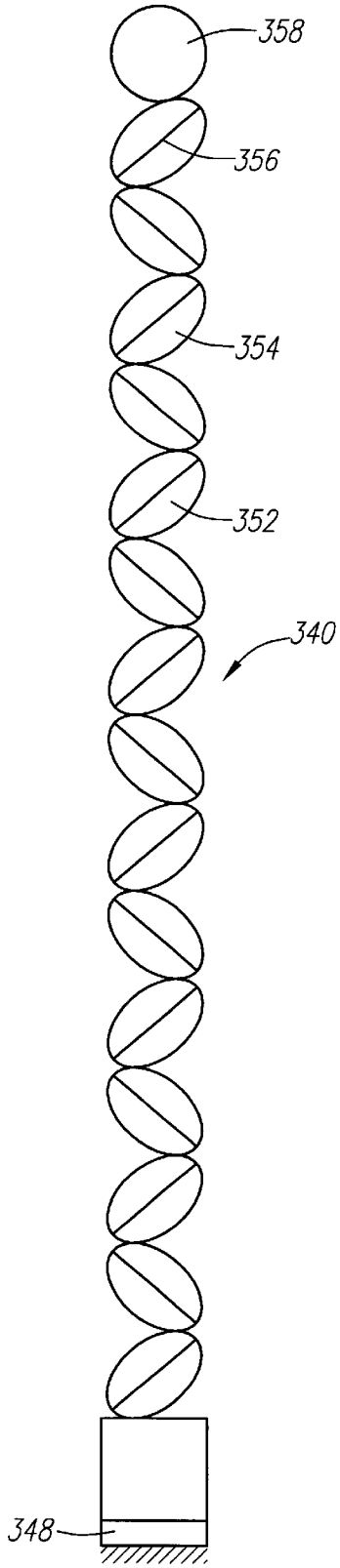

To prevent over inflation of the balloon a one way relief valve, such as those employed on BCD's may be employed, or more preferably, the one way valve 42 can be of the type to automatically shut off when a back pressure of a preset valve is detected. Referring now to FIGS. 4A–4C, various embodiments of a deployed hands free signal device constructed in accordance with the present invention are depicted. Generally, after inflation, the balloon member of the hands free signal device assumes an elongate shape, and projects upward from the body of the diver to whom it is attached. FIG. 4A depicts a hands free signal device 140 which includes a balloon 152. The balloon 152 is formed from a row of inflatable cells 154 which are interconnected and whose internal volumes are in communication with each other. In this manner, a single inflatable volume is maintained. Semi rigid support members 156 are included along the periphery of each of the cells 154 and help maintain the entire inflatable balloon member 152 in an erect and upright position when inflated. Uppermost cell 158 preferably includes an enhanced signaling feature such as a battery operated light, a radio transponder, 159 or a flare mechanism to further increase the visibility of the signal device. Additionally, an audible signaling device may be incorporated at the signaling end of the device. The entire length of the balloon member 152 is also preferably coated with a fluorescent, neon, or other bright color to increase its visibility. A luminescent paint is preferable for increased nighttime visibility.

FIG. 4B depicts a hands free signal device 240 which includes an inflatable balloon member 252. When inflated, balloon member 252 forms a substantially smooth elongate member. This single piece construction allows the hands free signal device 240 to retreat into a further reduced size.

FIG. 4C depicts a hands free signal device 340 which includes an inflatable member 352 formed from a row of inflatable cells 354. Each of the cells are interconnected and have internal volumes which and are in communication with each other. In this manner, a single inflatable volume is maintained. Each of the cells 354 includes a peripheral semi-rigid support member 356. The support members 356 help maintain the inflatable balloon 352 in an upright and erect position when inflated. The inflatable balloon 352 collapses in an accordion like fashion when retracted and allows for the support members 356 to be substantially stiffer since they are not required to roll up as do the support members 156 of the hands free signal device 140. The uppermost cell 358 preferably includes an enhanced signaling feature such as a battery operated light, a radio transponder or a flare mechanism to further increase the visibility of the hands free signal device or an audible signaling device. The entire length of the balloon member 352 is also preferably coated with a fluorescent, neon or other bright color to increase its visibility. A luminescent paint is preferable for increased nighttime visibility.

Figure 5:
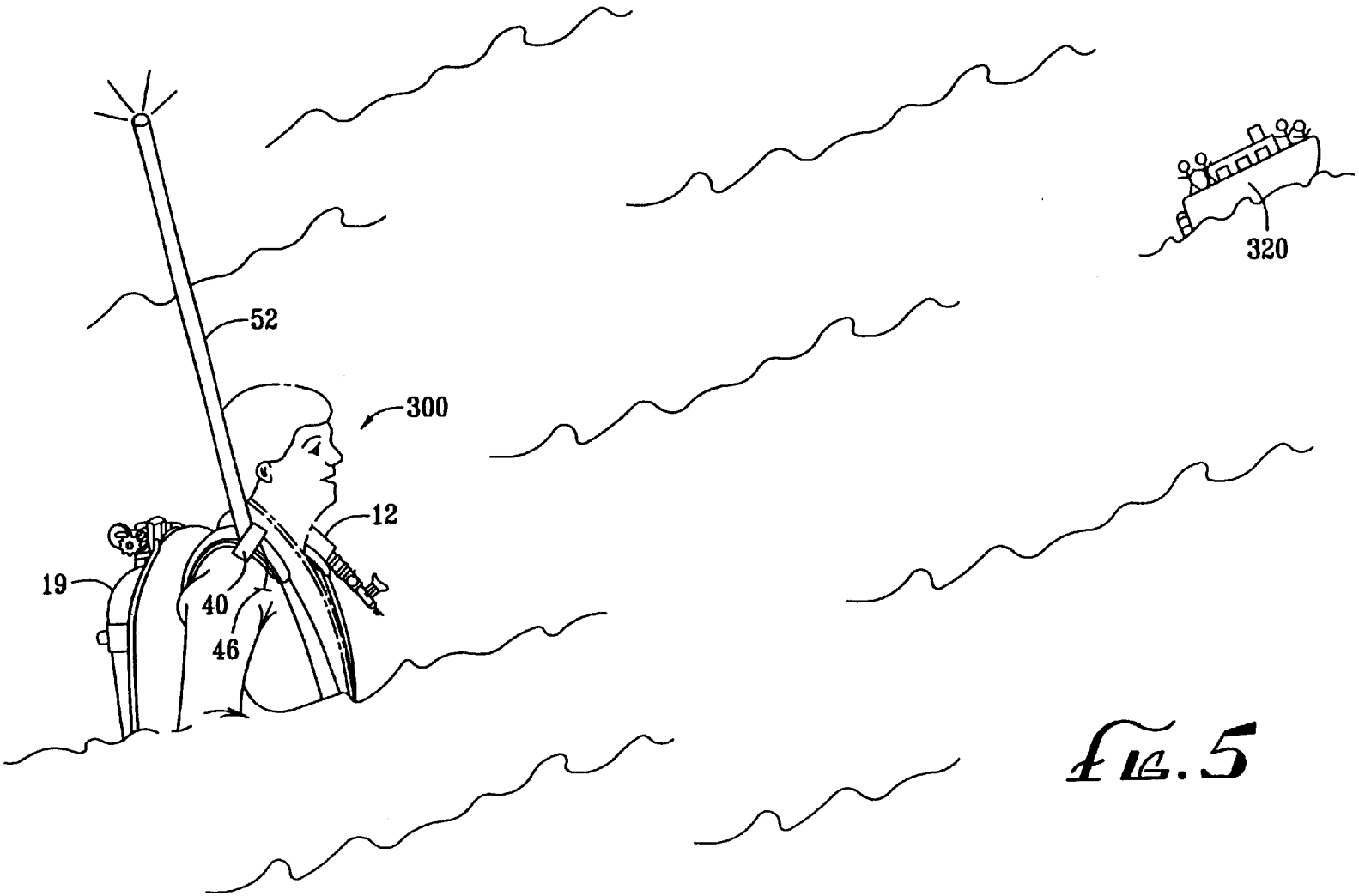
FIG. 5 illustrates the use of a hands free signaling device in accordance with the present invention.

FIG. 5 depicts a scuba diver 300 after surfacing from a dive. In an emergency situation or simply when the diver feels the need to attract attention, the diver may do so by opening a valve between a hands free signaling device and a pressurized air source to inflate a balloon of the hands free signaling device without having to attach the signaling device to the pressurized air source. The hands free signal device 40 maintains the balloon member in an erect and extended position without the diver having to hold the device. Those on a boat 320 can therefore locate the diver 300, even in rough water or poor visibility conditions. The diver 300 does not need to exert any additional energy to maintain the balloon member 52 in an upright position and can relax while the boat 320 comes to his aid.

A hands free signal device constructed in accordance with the present invention can incorporate additional features such as an automatic deployment mechanism which automatically inflates the balloon member 52 when a diver reaches the water surface or ascends too quickly. For automatic operation, most dive computers can calculate the rate of ascent. In an emergency ascent, the output of a dive computer can be connected to an automatic valve that opens when the predetermined rate of ascent is exceeded.

A hands free signal device constructed in accordance with the present invention can also be equipped with its own alternative compressed gas source to inflate the balloon member. A small canister of compressed carbon dioxide can be incorporated into the signaling device. By opening the valve 43, the gas is released and thereby inflates the balloon member 52. Such a configuration eliminates the dependency on the diver's compressed air tank and makes the signaling device a completely redundant system which can be easily mounted to any dive outfit. The standalone hands free signal device utilizing its own compressed gas system can be used by snorkelers or other swimmers who do not have a compressed air source to deploy the signaling device.

Additionally, a hands free signal device construction in accordance with the present invention can also be attached to an alternative ("pony") air tank, or to the first stage of a regulator assembly directly through a coupling to a low pressure port. Additionally, the hands free signal device can be attached to an overflow valve incorporated into a diver's BCD. BCD overflow valves are typically equipped with a release cord and include a threshold fitting. A hands free signal device constructed in accordance with the present invention can be adapted to engage with this threaded fitting and utilize the release cord on the overflow valve, rather than having its own cord and valve. In this manner, the air remaining in the BCD acts as the inflation source for the signal device and the signal device can be readily exchanged between users.

Audible components can also be incorporated into a signal device constructed in accordance with the present invention. For instance, a whistle or horn can be placed in line with the compressed air source. Any remaining air in the scuba tank can be used to sound the whistle or horn.

While the invention is susceptible to various modifications, and alternative forms, specific examples thereof have been shown in the drawings and are herein described in detail. It should be understood, however, that the invention is not to be limited to the particular forms or methods disclosed, but to the contrary, the invention is to cover all modifications, equivalents and alternatives falling within the spirit and scope of the appended claims.

What is claimed is:

1. A hands free signal device comprising:

an inflatable member defining an internal volume; said inflatable member having an uninflated state and an elongate inflated state, a fitting having an inflation end;

said inflation end connected to said inflatable member;

said fitting further comprising a valve, said valve connected to an inflation source by a hose and operable to allow communication from said inflation source to said internal volume;

and an actuator, said actuator connected directly to said valve for selectively opening and closing said valve to allow communication between said internal volume and said inflation source and cause said inflatable member to change from said uninflated state to said inflated state;

wherein said inflatable member is rigidly attached to a BCD when said inflatable member is in said uninflated state and remains rigidly attached to said BCD when said inflatable member is in said inflated state.

2. The hands free signal device of claim 1, wherein said inflation source is a cylinder of compressed gas.

3. The hands free signal device of claim 2, wherein said cylinder of compressed gas is a scuba tank.

4. The hands free signal device of claim 1, said hose having a first end and a second end, said first end connected to said valve and said second end connected to a low pressure port of a first stage of a regulator; said first stage connected to said inflation source.

5. The hands free signal device of claim 1, wherein said valve is a one way valve.

6. The hands free signal device of claim 1, wherein the actuator is a pull cord and wherein a force exerted on the pull cord opens said valve to cause said inflatable member to change from said uninflated state to said inflated state.

7. The hands free signal device of claim 1, wherein said inflatable member is a balloon.

8. The hands free signal device of claim 1, wherein the inflatable member comprises:

a plurality of cells, each cell defining an internal volume, the internal volumes being in communication with each other; and at least one semi rigid support member attached to a peripheral edge of each cell.

9. The hands free signal device of claim 1, further comprising a radio transponder, wherein the transponder is activated by inflating the inflatable member.

10. The hands free signal device of claim 1, wherein said inflatable member is removably attached to said BCD by a fastening device.

11. The hands free signal device of claim 10, wherein said fastening device is selected from the group consisting of a velcro strip a snap, a button, and a zipper.

12. The hands free signal device of claim 1, wherein said inflation source is a canister of compressed carbon dioxide.

13. the hands free signal device of claim 1, wherein said inflatable member has the shape of a rolled coil in said uninflatable state and wherein said inflatable member has the shape of an elongate tube with a substantially cylindrical profile in said inflated state.

14. The hands free signal device of claim 1, wherein said valve is a buoyancy compensation device overflow valve.

15. An inflatable bands free signaling device comprising:

a base attached to a scuba buoyancy compensation device, said base including a fitting adapted to engage with a scuba regulator hose, said fitting including a one way valve;

a collapsible balloon rigidly attached to said base and in communication with said fitting; said collapsible balloon having a collapsed state and an elongate inflated state; said base attached to said scuba buoyancy compensation device when said collapsible balloon is in said collapsed state and when said collapsible balloon is in said inflated state; and an actuator connected directly to said valve an being adapted to open and close said valve.

* * * * *